United States Patent [19]

Blais

[11] Patent Number: 4,649,579

[45] Date of Patent: Mar. 17, 1987

[54] SWIMMING POOL SKIMMING WEIR

[75] Inventor: Marc H. Blais, Westerville, Ohio

[73] Assignee: M. Blais Co., Westerville, Ohio

[21] Appl. No.: 795,763

[22] Filed: Nov. 7, 1985

[51] Int. Cl.[4] ..... E04H 3/16

[52] U.S. Cl. ..... 4/507; 4/508; 137/404; 210/129; 210/169; 210/242.1

[58] Field of Search ..... 4/392, 393, 507, 508, 4/510, 512; 137/404, 448; 210/119, 121, 123, 129, 169, 196, 242.1

[56] References Cited

U.S. PATENT DOCUMENTS

| | | | |
|---|---|---|---|
| 3,428,078 | 2/1969 | Christopher | 137/448 |
| 4,011,164 | 3/1977 | McGivern | 210/242.1 |
| 4,133,058 | 1/1979 | Baker | 4/510 |
| 4,146,937 | 4/1979 | Baker | 210/169 |
| 4,253,202 | 3/1981 | Norris | 4/512 |
| 4,348,281 | 9/1982 | Perry | 210/169 |
| 4,380,837 | 4/1983 | Corna | 4/512 |
| 4,494,257 | 1/1985 | Peirish | 4/508 |

*Primary Examiner*—Ernest G. Therkorn
*Attorney, Agent, or Firm*—James H. Tilberry

[57] ABSTRACT

A device is provided to control the level of water in the gutter of a swimming pool which is responsive to the level of water in the pool. Weirs are provided on the pool side of the gutter to which weir housings are attached to conduct skimming and/or surge water into the gutter. Each weir housing is provided with a hollow floodable trough-like gate which can be adjusted to control the inflow of water past the gate. The gates are individually adjusted about the perimeter of the pool to control the inflow of water as a function of distance from the water outflow end of the gutter.

20 Claims, 6 Drawing Figures

SWIMMING POOL SKIMMING WEIR

BACKGROUND OF THE INVENTION

Modern competition and mass recreation size swimming pools are provided with perimeter water circulating systems, such as illustrated in U.S. Pat. Nos. 4,179,761; 4,316,571 and 4,400,834. These systems include a pressurized perimeter tube to supply water to the pool on a continuous flow basis. Associated with this tube is a gutter adapted to conduct water from the pool to filtration systems from which the water is then returned to the perimeter tube.

Pool sanitation is a major concern of pool operators and is regulated by state health departments. For instance, it has been long recognized that accumulations of body hair and hair oils, and other forms of floating pool contaminants and debris should be removed from the pool on a regular and systematic basis in order to maintain a safe environment for swimmers. However, if a pool gutter is flooded due to a surge of water caused by a large influx of swimmers, accumulated contaminants and debris in the gutter will be flushed back into the pool. To prevent gutter flooding many state health departments require that the surge storage capacity of pool gutters be at least one gallon per square foot of pool surface area. In addtion, surge tanks adjacent to the pool with connections to the gutters are also required by state regulations. Subsequent to the promulgation of these regulations, pool surface skimming and surge control devices have been developed which have eliminated the need for surge tanks. These devices have generally been accepted by state health departments in lieu of surge tanks because they provide a more efficient sanitary gutter system at substantial savings over the surge tank system.

Skimming devices serve two functions. The first is to provide pool surface skimming which effectively removes floating contaminants and debris from the pool. The second is to provide state required in-pool surge capacity. Examples of prior art skimming devices intended to serve these two functions are disclosed in the following U.S. Pat. Nos.: 3,668,713; 3,918,107; 4,112,526; 4,146,937; 4,173,799; and 4,494,257.

In theory the skimmers operate by accepting a steady flow of water from the pool surface when the pool is quiescent, but which close responsive to a sudden surge of water. When the skimmers close, water can only reach the gutter by entering over the gutter rim. Since the gutter rim is several inches higher than the skimmer weir, properly designed, the gutter has adequate capacity and time to accept the surge without flooding. In practice, however, it is a general observation that most prior art skimmers are erratic in their ability to remain closed when a local surge occurs. Thus, for example, U.S. Pat. Nos. 4,173,799 and 4,146,937 disclose skimmers which will fluctuate when local surging occurs. U.S. Pat. No. 3,668,713 will fluctuate when local surging occurs and will also fail completely when the water in the gutter reaches a certain critical level.

SUMMARY OF THE INVENTION

The present invention relates to an improved and novel means for closing a skimmer based on a principal not heretofore employed in this art. My present invention is based on the concept of causing a hollow trough-like weir gate to close by flooding it with surge water from the pool. The water entering the hollow gate acts as ballast and forces the gate closed.

A plurality of weirs about the perimeter of the gutter system are each connected to a weir housing within the gutter adapted to channel surge water from the pool into the bottom of the gutter at varying predetermined rates.

With this mechanism it is possible to maximize the water intake of the skimmers remote from the gutter outflow means and to progressively decrease the water intake of the skimmers closer to the outflow means.

OBJECTS OF THE INVENTION

It is therefore among the objects of my invention to provide a novel swimming pool skimming weir, hereinafter referred to herein as a "skimmer", which is pool water level actuated, water ballast closed, efficient, trouble free, inexpensive to manufacture, easy to install and to maintain, automatically resetting and adjustable to beneficially coact with other like skimmers in a pool perimeter gutter system to balance the flow of water into the gutter.

DETAILED DESCRIPTION OF THE INVENTION

Figure 1:
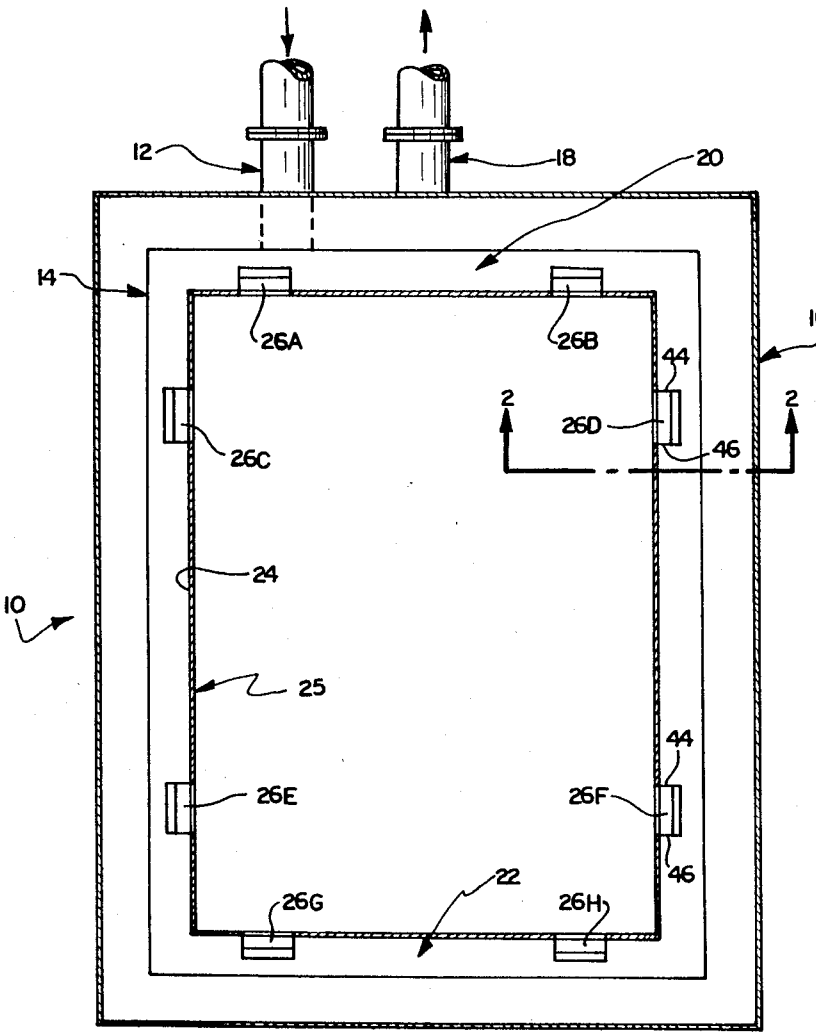
FIG. 1 is a schematic plan in partial section taken along the line 1—1 of FIG. 2, of a swimming pool gutter having skimmers installed about the periphery of the gutter.

Referring first to FIG. 1, the perimeter circulating system includes a water inflow pipe 12 which connects and feeds water to a perimeter water tube 14 mounted within gutter 16. A water outflow pipe 18 is connected to the gutter 16 at its low gradient zone 20. The high gradient zone 22 of the gutter 16 is remote from the low gradient zone 20. Mounted on the interior surface 24 of the pool side gutter wall 25 are a plurality of skimmers 26A–H which are balanced for water intake so that the gutters adjacent the gutter high gradient zone are adjusted to maximum open position, the skimmers adjacent the gutter low gradient zone are adjusted to minimum open position and the gutters in between are adjusted to progressively smaller open positions the closer the skimmers are to the gradient low point. It will be understood that the number and location of skimmmers in a perimeter gutter system will vary depending on pool size, use and other factors known to those skilled in the art.

Figure 2:
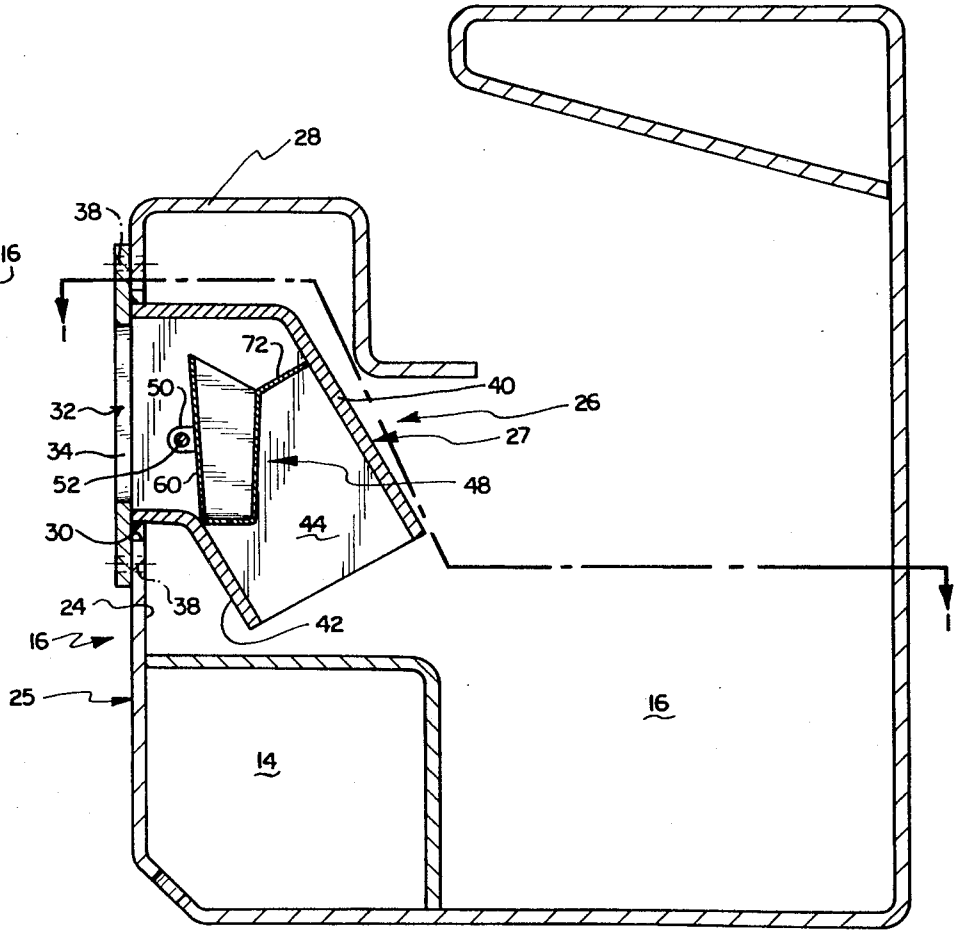
FIG. 2 is an elevational view in section taken along the line 2—2 of FIG. 1, of a preferred embodiment of the invention with the hollow weir gate in the at-rest position.
Figure 3:
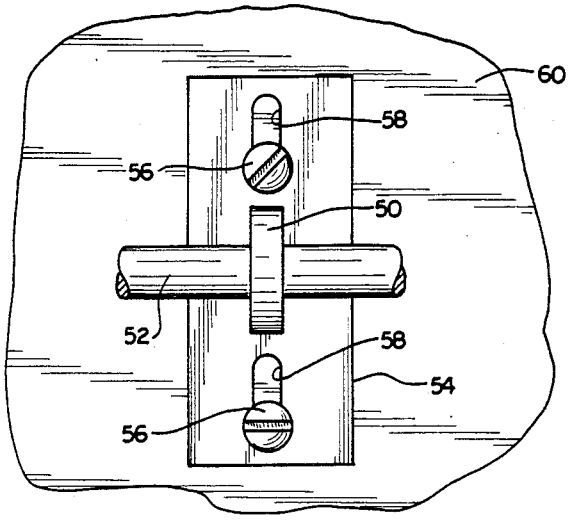
FIG. 3 is a fragmentary elevational view of the weir gate pivotal rod adjusting means.
Figure 4:
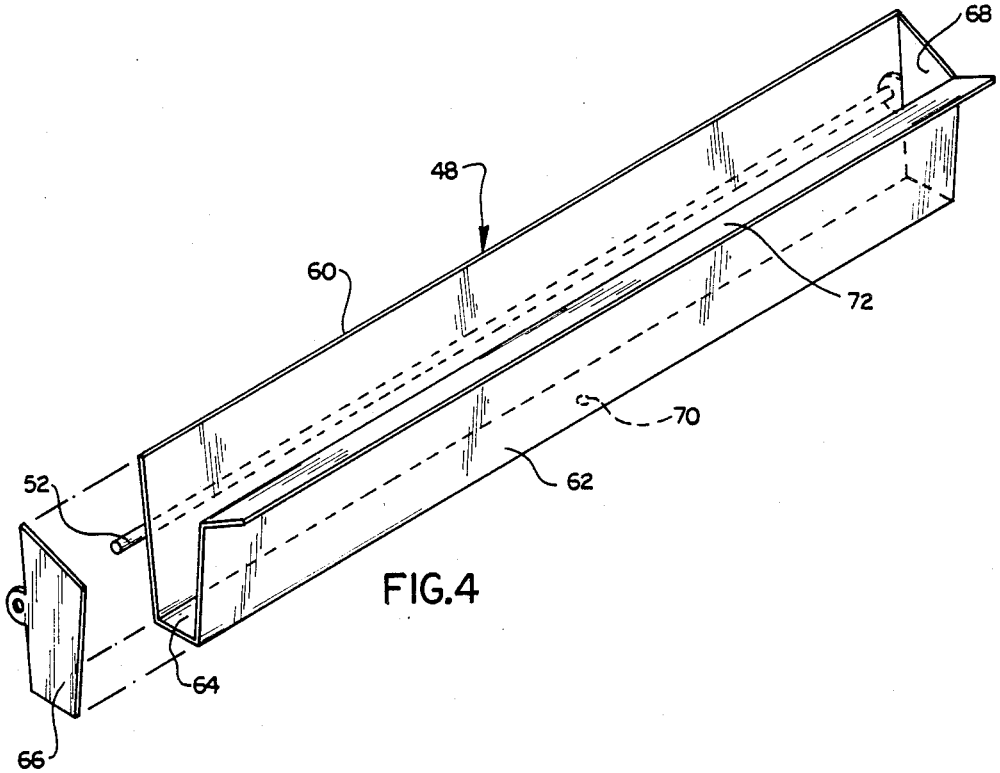
FIG. 4 is an isometric partially exploded view of a preferred embodiment of the trough-like weir gate employed in the invention.

Referring next to FIG. 2, therein is shown a side gutter wall 25 which merges with a horizontal gutter lip 28. Mounted on the gutter wall 25 and beneath the gutter lip 28 is a preferred embodiment of the subject skimmer 26. The skimmer 26 includes a slotted skimmer weir housing mounting plate 32 provided with weir slots 34, such as generally shown in FIG. 4 of U.S. Pat. No. 4,380,837. Plate 32 covers a hole 30 in gutter wall 25. Mounting plate 32 is secured to skimmer weir housing 27, such as by welding, and to wall 25 such as by threaded fasteners indicated schematically at 38. Weir housing 27 includes a top plate 40, a bottom plate 42 and left and right side plates 44 and 46 (see also FIG. 1). Pivotally secured in weir housing 27 is a weir gate 48 mounted on gimbals 50 to pivot about a horizontal pivotal rod 52, the ends of which are mounted in opposite vertical sides 44 and 46 of housing 27. As best shown in FIG. 3, gimbals 50 are mounted on adjusting plates 54 and threaded fasteners 56 in adjusting slots 58 are adapted to adjustably secure adjusting plates 54 to the front wall 60 of weir gate 48.

As best shown in FIG. 4, weir gate 48 comprises a water trough having a front wall 60 and a rear wall 62 spaced rearwardly from front wall 60 to provide for a bottom wall 64, which is formed by bending and lapping lower portions of front and rear walls 60 and 62. The trough is made water tight by end walls 66 and 68. A drain hole 70 is provided in bottom plate 64 to permit the trough to empty only after the water in the pool recedes to a normal level. Secured to the upper edge of back wall 60 is an angulated baffle and sealing plate 72, which, as shown in section in FIG. 2, makes sealing contact with weir housing top plate 40 when the lower edge of front wall 60 makes sealing contact with the weir housing bottom plate 42. The turning moment of weir gate 48 about pivotal rod 52 is such that gate 48 normally pivots into the sealing or closed position shown in FIG. 2.

OPERATION OF THE INVENTION

Figure 5:
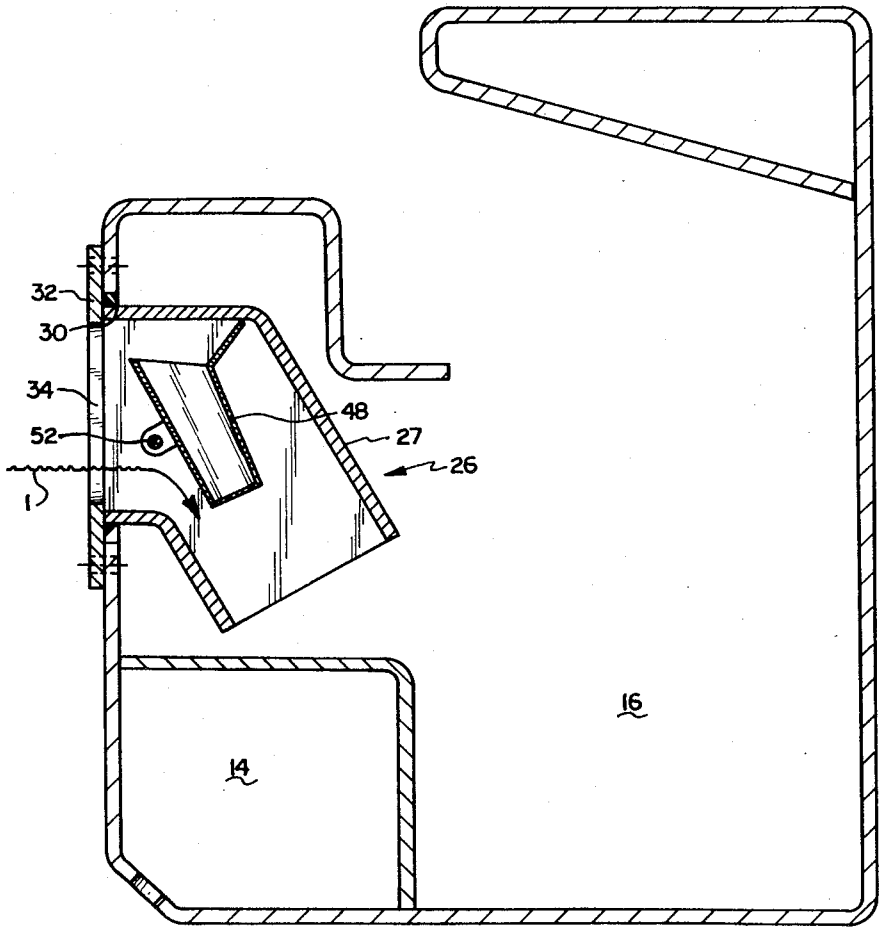
FIG. 5 is an elevational view in section of the preferred embodiment of the invention shown in FIG. 2 but with the weir gate in the open position.

Good pool operation requires that the normal level of the pool when quiescent be slightly above the bottom edges of the weir slots 34 in weir mounting plate 32. Thus, as shown in FIG. 5, when the pool is at a normal water level 1, the combination of a lightweight weir gate 48, made from 28 gauge stainless steel or plastic, and the position of the pivotal rod 52 permits the gate 48 to pivot open with a minimum of force applied by water skimming from the surface of the pool through weir slots 34 into weir housing 27. The skimming water deflects the gate 48 in a counter-clockwise direction to permit a steady flow of water into the gutter 16 at a measured rate.

Figure 6:
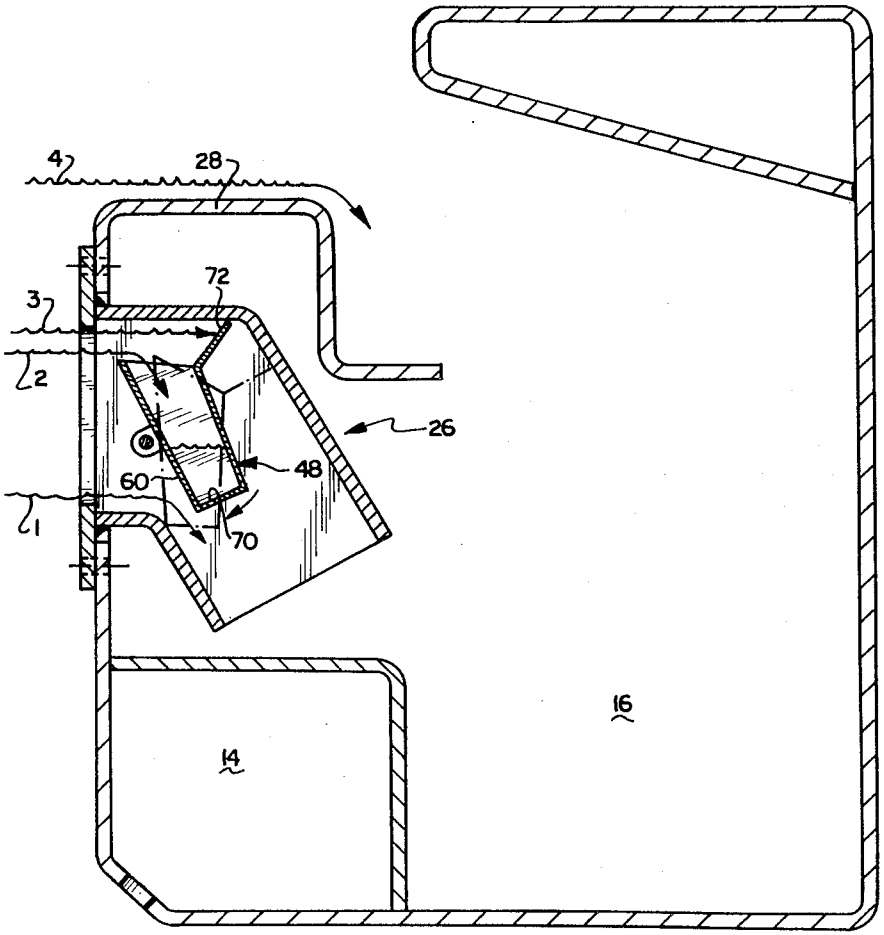
FIG. 6 is an elevational view in section of the preferred embodiment of the invention, shown in FIG. 2, but with the weir gate shown alternately in the open and closed positions.

When the pool is in use, the swimmers will displace the water in the pool thereby raising the water level of the pool. As shown in FIG. 6, when the water reaches level 2, water will pour into the gate trough weighting the lower end and causing the gate to pivot in a clockwise direction until the weir is closed as shown in phantom. To assist in quickly closing the gate 48 as the pool water level rises to level 3, water will impact against the baffle plate 72, creating a second turning moment about pivot rod 52 in a clockwise direction to expedite closing of the weir. Further water displacement may cause the pool level to increase to level 4, wherein water will pour over gutter lip 28 into the gutter 16. If the gutter is flooded to at least above drain hole 70, the ballast water in gate 46 cannot completely drain through drain hole 70. Accordingly, the gate 48 will remain closed until the pool water recedes to level 1. Whereupon, the water in weir housing 27 will run off as the water in the gutter recedes. Even though the weir housing 27 is substantially drained, the slow metered draining of the ballast water from the gate trough will keep the gate closed until a quiescent condition is again restored to the pool. By this time, the gate trough will usually have been substantially emptied, rendering it again yieldable to the normal skimming flow from the pool, whereinafter the trough fully drains.

It is to be particularly noted that, unlike ball float actuated gates, the subject weir gate 48 will not flutter responsive to surging caused by variations in pool water displacement. Once the gate 48 closes, it will stay closed until pool conditions permit the gate water ballast to drain out.

The amount the gate 48 will open responsive to the inflow of skimming water into the weir housing 27 is a function of the position of the pivot rod 52 on the face of gate front wall 60. Thus, by shifting the rod vertically upwardly, the weight of the gate beneath the pivot rod will be increased, the counterweight of the portion of the gate above the pivot rod will be reduced, the consequent force required to open the gate will be increased and the opening will be reduced. Conversely, by shifting the pivot rod downwardly, by the same analogy, the gate opening will be increased. It is thereby possible with the subject invention to fine tune each weir about the perimeter of the pool so that only the proper rate of volume of water will pass through the weir relative to the other weirs in the gutter. Thus, in order to prevent flooding of the gutter at the low gradient zone 20 of the pool, FIG. 1, weirs 26A and B can be throttled down, whereas weirs 26C and D, 26E and F and 26G and H may be progressively opened with weirs 26G and H being adjusted to open the widest. With skimming flow thus balanced around the system, the gutter is more able at all times to receive sudden surges of water without flooding and back washing into the pool.

I have thus provided a simple, trouble free, positive acting skimmer weir which will not flutter but instead will close and stay closed until pool conditions are proper for it again to reopen. Numerous modifications and variations of the subject invention may occur to those skilled in the art upon a study of this disclosure. It is therefore to be understood that, within the scope of the appended claims, the invention may be practiced otherwise than as described in the specification and illustrated in the drawings.

What is claimed is:

1. In a water level actuated weir for a swimming pool gutter having a pool side opening positioned at a predetermined first pool water level and a weir housing positioned within said gutter to enclose said opening and to direct surge water from said pool into said gutter, the improvement comprising: floodable weir gate means pivotally secured in said housing and adapted to pivot into and out of closing contact with the interior of said housing and wherein said weir gate comprises a normally empty water holding trough normally at rest and in sealing contact with the interior of said weir housing; pivot means positioned to permit said gate to pivot out of closing contact with the interior of said housing when pool water is at a first level and said gate is in an unflooded condition and to pivot into sealing contact with the interior of said housing when the pool water is at a second level high enough to flood said gate.

2. The device of claim 1, wherein said trough being pivotally balanced to swing open upon inflow of pool water into said weir housing at said first level and to swing closed upon inflow of pool water into said weir housing and into said trough at said second level.

3. The device of claim 2, including metered port means to drain said trough when the water in said gutter recedes to a level below said second level.

4. The device of claim 2, wherein said trough includes a front wall pivotally secured to said weir housing for partial rotation about a horizontal axis; and a spaced apart rear wall extended to delimit the pivotal movement of the trough into the open position and to make sealing engagement with the interior of the weir housing when said trough is in the closed position.

5. The device of claim 4, including means to vertically shift said horizontal axis of rotation.

6. The device of claim 4, wherein said front and rear walls are spaced apart and secured to a bottom wall; said front wall being planar and said rear wall comprising a first portion secured to said bottom wall and a second portion secured to the top of said first portion angulated away from said first portion to contact the interior of said housing.

7. The device of claim 6, wherein said weir housing in longitudinal cross section comprises a top first horizontal section and a second downwardly angulated section whereby said trough rear wall second portion is free to pivot between said first horizontal section and said second downwardly angulated section.

8. The device of claim 6, including metered port means in said bottom wall to drain said trough.

9. In a water level actuated weir for a swimming pool perimeter gutter having pool side openings at horizontally spaced intervals along the perimeter of said gutter and weir housings positioned within said gutter to enclose said openings and to direct overflow water from said pool into said gutter, the improvement comprising: weir gates pivotally secured in said weir housings and adapted to pivot about horizontal axes into and out of closing contact with the interiors of said weir housings and wherein said weir gates comprise normally empty water holding troughs normally at rest and in sealing contact with the interiors of said weir housings; adjustable pivot means adapted to permit said weir gates to pivot out of closing contact with the interiors of said weir housings when pool water is at a first predetermined level and to pivot into closing contact with the interior of said weir housings when pool water is at a second predetermined higher level, the horizontal pivotal axes of each weir gate being selectively positioned to provide a controlled metered flow of gutter water toward the discharge end of said gutter.

10. The device of claim 9, wherein the said weir gates are pivotally adjusted to permit progressively decreasing amounts of pool overflow water to enter the gutter the closer said weir gates are positioned to the discharge end of said gutter.

11. The device of claim 10, wherein the horizontal pivotal axes of said weir gates are shifted upwardly to decrease inflow of pool water into said weir housings and are shifted downwardly to increase the inflow of pool water into said weir housings.

12. In a water actuated weir for a swimming pool gutter comprising a weir housing mountable in said gutter; a shiftable weir gate mounted in said housing; and wherein said weir gate comprises a normally empty water holding trough normally at rest and in sealing contact with the interior of said weir housing; and a floodable water commpartment in said gate adapted when flooded to shift said gate from a first position to a second position.

13. The device of claim 12, including means to drain said water compartment when said gate is in said second position.

14. The device of claim 12, wherein said gate is adapted to initially shift to said first position responsive to an inflow of water skimming from a pool at a first level.

15. The device of claim 12, wherein said gate is adapted to shift from said first position to said second position responsive to an impact of water against said weir gate at an appreciable level above normal pool water level.

16. The device of claim 12, wherein said gate it adatped to initially shift to said first position responsive to an inflow of water skimming from a pool at a first level, and said gate is adapted to shift from said first position to said second position upon impact of water against said gate at a second level appreciably above said first level.

17. The device of claim 12, wherein said gate has an upper portion and a lower portion and is adapted to pivot about a horizontal axis between said and lower portions and whereby the force of skimming water pressure against said lower portion will cause said gate to pivot into a first position and the force of water pressure against said upper portion and the flooding of said water compartment will cause said gate to pivot from said first position to said second position.

18. The device of claim 12, wherein said gate has an upper portion and a lower portion, is adapted to initially shift from a closed position to an open position upon the application of water pressure against said lower portion and is adapted to shift from an open position to a closed position upon the flooding of said water compartment through port means in said upper portion.

19. In a swimming pool gutter weir housing, a water pressure actuated gate shiftably mounted in said weir housing; said gate having upper and lower portions and a floodable water compartment adjacent said lower portion; said weir gate comprising a normally empty water holding trough normally at rest and in sealing contact with the interior of said weir housing; and said gate being adapted to shift open upon the application of water pressure against said portion and adapted to shift closed upon application of water pressure against said upper portion and flooding of said water compartment.

20. The device of claim 19, including means to release water from said water compartment wherein said gate is rendered openable.

* * * * *